US009861901B1

(12) United States Patent
Pierzynski et al.

(10) Patent No.: US 9,861,901 B1
(45) Date of Patent: Jan. 9, 2018

(54) EASILY TRANSPORTABLE INFLATION AND DEFLATION ASSEMBLY FOR A BOUNCE HOUSE

(71) Applicant: MGA Entertainment, Inc., Van Nuys, CA (US)

(72) Inventors: Andrew Pierzynski, Cuyahoga Falls, OH (US); Jeffrey Paris, Los Angeles, CA (US); Glenn Yu, El Segundo, CA (US); Joseph Chang, Los Angeles, CA (US)

(73) Assignee: MGA ENTERTAINMENT, INC., Van Nuys, CA (US)

( * ) Notice: Subject to any disclaimer, the term of this patent is extended or adjusted under 35 U.S.C. 154(b) by 0 days.

(21) Appl. No.: 15/449,563

(22) Filed: Mar. 3, 2017

(51) Int. Cl.

| | |
|---|---|
| ***A63G 31/16*** | (2006.01) |
| ***A63G 31/12*** | (2006.01) |
| ***E04H 15/20*** | (2006.01) |
| *A45C 5/02* | (2006.01) |

(52) U.S. Cl.
CPC ..... *A63G 31/12* (2013.01); *E04H 15/20* (2013.01); *A63G 2200/00* (2013.01)

(58) Field of Classification Search
CPC ..... A63G 31/00; A63G 31/12; A63G 31/16; A47D 9/02; A47D 13/00; A47D 13/107; A45C 5/02; A45C 5/03; A45C 5/14; A45C 13/10; A45C 13/262
USPC ..... 472/135–137; 190/107, 115, 124
See application file for complete search history.

(56) References Cited

U.S. PATENT DOCUMENTS

2001/0011620 A1* 8/2001 Tiramani ..... A45C 5/02 190/124

OTHER PUBLICATIONS

Aerobed with travel case, product photos and product descriptions. Shopvac product brochure. See blower port show on, e.g., p. 2.

* cited by examiner

*Primary Examiner* — Kien Nguyen
(74) *Attorney, Agent, or Firm* — Intellectual Property Law Offices of Joel Voelzke, APC

(57) ABSTRACT

An assembly for an inflatable structure such as a child's bounce house, and for storing and transporting the bounce house, includes a wheeled dolly having a handle, an electric air blower mounted to the dolly near the wheels, an adapter for use in deflating the bounce house using the air blower, and a cover that is attached or attachable to the dolly for securing the bounce house in its deflated state to the dolly and for covering the bounce house.

20 Claims, 9 Drawing Sheets

EASILY TRANSPORTABLE INFLATION AND DEFLATION ASSEMBLY FOR A BOUNCE HOUSE

CROSS-REFERENCE TO RELATED APPLICATIONS

None.

BACKGROUND OF THE INVENTION

1. Field of the Invention

This invention relates to the field of inflatable structures. More particularly, this invention relates to the field of an easily transportable inflation and deflation assembly for an inflatable structure such as a bounce house.

2. Description of Related Art

One type of inflatable structure is a child's bounce house. Bounce houses have soft, inflated floors and some type of containment structure to keep children within the structure. The containment structure typically includes inflatable vertical supports located around the periphery of the inflatable floor, the vertical supports being integral with the inflatable floor, and with netting between the vertical supports. The inflated vertical supports and netting stretched between them provides a soft containment structure around the soft floor that contains the children within the bounce house. The bounce house thus provides a soft, bouncy floor and walls in which children can jump and bounce and play in a pillowy, forgiving environment.

Bounce houses are popular items for children, especially for groups of children at birthday parties or other events. A number of companies provide bounce houses on a per-event basis, providing both the bounce house and often the personnel to set the bounce house up at a customer's home or other play venue, and to then to deflate and take down the bounce house and return it at the end of the day or other rental period.

There remains a need, however, for bounce houses that are more easily transported, inflated, and deflated, especially for untrained personnel such as parents to transport and operate, and especially without equipment that is heavy, bulky, and awkward to move.

SUMMARY OF THE INVENTION

The present invention allows inflatable structures such as childrens' bounce houses to be easily transported to a use location such as a public park, inflated for use, and then deflated afterwards and transported back, and stored, with all necessary equipment being both easily transported as well as stored in a relatively small space such as in the corner of a garage of a typical home.

According to an exemplary embodiment of the invention, an assembly for a bounce house and for transporting and inflating and deflating the bounce house includes a wheeled dolly on which an electric air blower for inflating and deflating the bounce house is mounted. The dolly includes a frame having a surface on which the deflated bounce house is placed, and a strap for securely holding the bounce house on the dolly. A cover or bag is positioned over the deflated bounce house, and attaches to the frame to further hold the deflated bounce house on the dolly and to cover the equipment and protect it. The cover can include nylons straps which attach to the dolly. The air blower and deflated bounce house are preferably positioned on the dolly such that the center of gravity of the assembly is over the wheels, or close to being over the wheels, when the dolly is being pushed or pulled by a user such that the assembly feels light to the user. The assembly can include a deflation adapter that allows the bounce house inflation tube to be connected to the air blower's intake port, thus allowing the air blower to be used as a suction pump that quickly deflates the bounce house and allows it to be folded up into a compact form for placing onto the dolly for transportation and storage.

In another embodiment the cover that attaches to the dolly is a rigid cover such as a plastic box that both protects the bounce house during transportation and storage, and allows additional items to be stacked thereon, thus reducing the effective storage space that the assembly requires.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Figure 1:
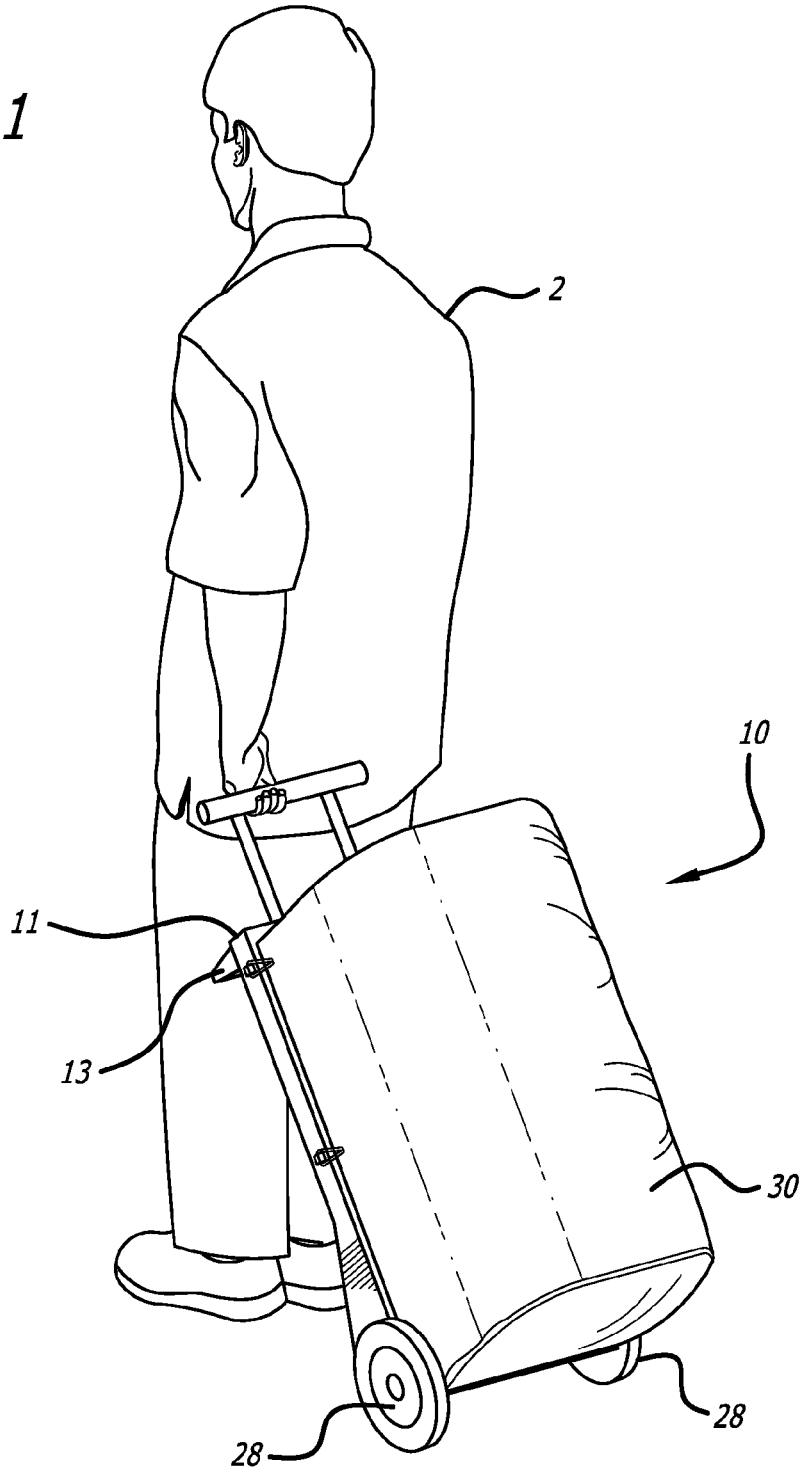
FIG. 1 is an oblique view of a user wheeling the assembly according to a first exemplary embodiment which includes a soft cover.

FIG. 1 is an oblique view of a user 2 wheeling the bounce house and associated equipment assembly 10 according to a first exemplary embodiment which includes a soft bag-like cover 30. Assembly 10 includes a frame 12 that rolls on a pair of wheels 28 over the ground or other surface. Wheels 28 are spaced apart on laterally opposite sides of frame 12. Frame 12 and wheels 28 together define a wheeled dolly 11.

Figure 2:
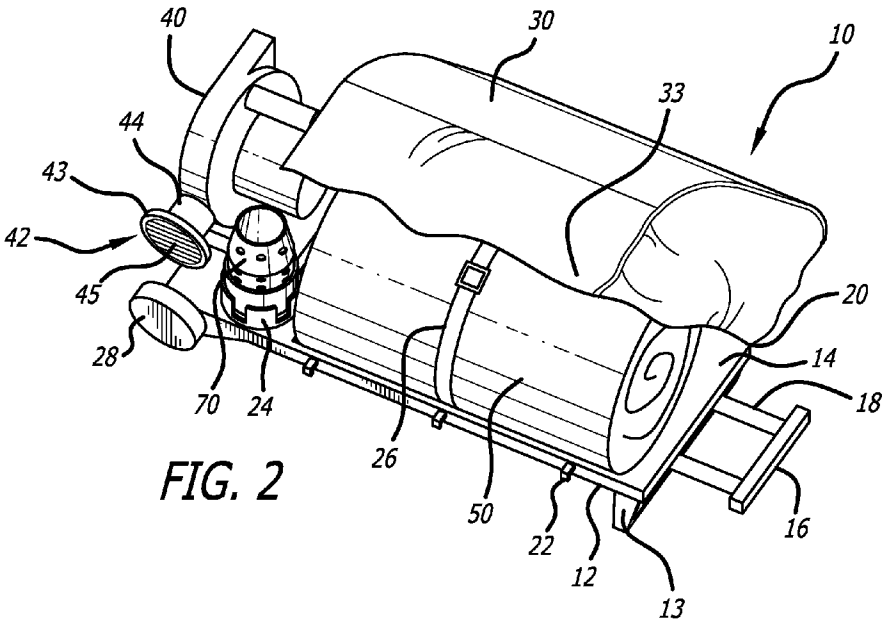
FIG. 2 is an oblique view of the assembly of FIG. 1, with the cover partially opened.

FIG. 2 is an oblique view of the assembly of FIG. 1 with the cover 30 partially opened. Cover 30 is partially cut away at its bottom end near air blower 40 in order to better reveal features near that end. In actuality, cover 30 preferably extends over air pump 40 as better illustrated in FIG. 1. Wheeled dolly 11 includes a support surface or platform 14 upon which a deflated inflatable structure 50, such as a child's bounce house that has been deflated and folded or rolled up, rests. Strap(s) 26 or other retention means hold deflated bounce house 50 securely on dolly 11. Cover 30 includes fasteners 33 that attach to attachment points 22 on frame 12. Cover 30 includes fasteners 23 that may be of any known fastening means such as straps, buckles, zippers, snaps, latches, and ties, allowing the free end of cover 30 to be easily and releasably attached to frame 12.

Dolly 11 includes a handle 16 for a user to grasp when rolling the assembly, and tubes 18 that may be telescoping tubes similar to those on rolling luggage, with the tubes retracting into frame 11 for storage, and with the tubes lockable in both the retracted and extended positions.

Assembly 10 including dolly 11 further includes an electrically powered air pump or blower 40 mounted to dolly 11, and a mounting structure 24 on which a deflation adapter 70 is mounted and secured. Air blower 40 can be removably mounted to dolly 12 such as by screws or bolts. Air blower 40 has both an intake port 46 (FIG. 6) which functions as a deflation port, and an exhaust port 42 which functions as an inflation port. Preferably both the inflation and deflation ports have safety gratings such as the safety grating 45 seen in FIG. 2 over inflation port 42, and safety grating 47 seen in FIG. 9 over deflation port 46. Those safety gratings prevent a child from putting his hands or fingers into the ports and thus risking injury when the air blower 40 is powered on. Air blower 40 includes an electrical power cord (not shown) and optionally a power on/off switch.

Fabric cover 30 can be releasably attached to frame 12 at a number of attachment points 20 such as via straps, buckles, zippers, snaps, latches, ties, and other known suitable fastening means. The attachment points can function as a hinge along one longitudinal edge of the cover, allowing fabric cover 30 to be effectively hinged to frame 12.

Figure 3:
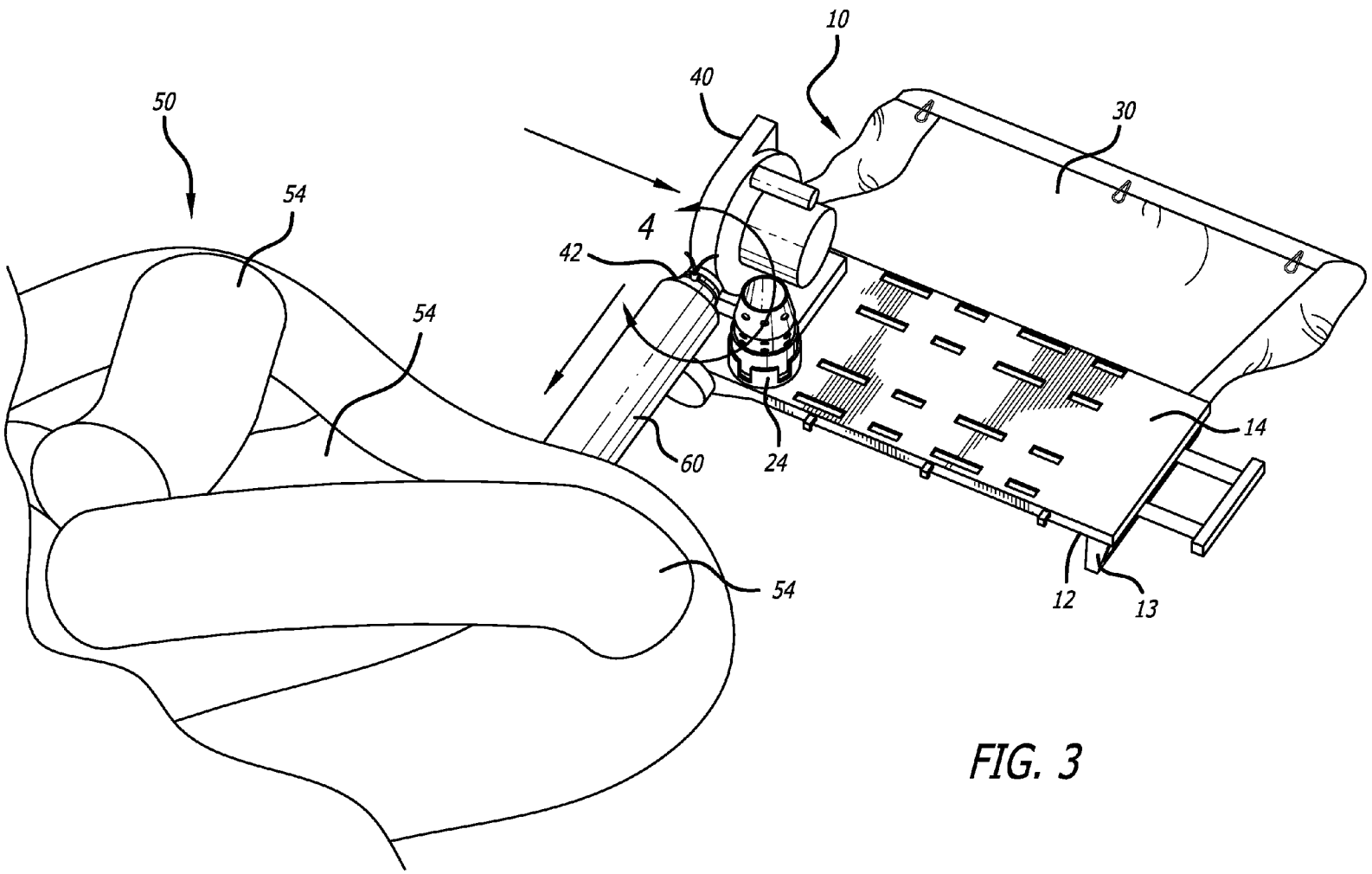
FIG. 3 is an oblique view of the assembly of FIG. 1, with the bounce house's inflation tube being connected to the air blower and the bounce house partially inflated.

FIG. 3 is an oblique view of the assembly of FIG. 1, with the bounce house's inflation tube 60 being connected to the air blower 40, and the bounce house 50 partially inflated. Leg 13 supports frame 12 so that frame 12 remains level with the ground in the position shown.

Figure 4:
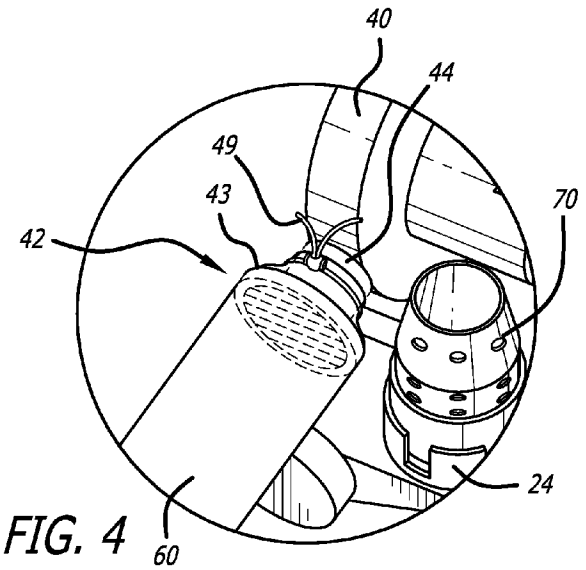
FIG. 4 is a close-up view of FIG. 3 in the area around the air blower's inflation port.

FIG. 4 is a close-up view of FIG. 3 in the area around the air blower's inflation port 42. Inflation port 42 includes a flange 43 affixed to a tube 44. The flange diameter is larger than the tube diameter. The flexible inflation tube 60 of the bounce house is attached to the inflation port 42 by placing the open end of inflation tube 60 over flange 43 and tube 44, and is held there by a closure and retention means such as elastic tie 49, a rope, or similar tie. The tie can be affixed to inflation port 60 such as by glue, heat sealing, or stitching in order to more positively hold inflation tube 60 over flange 43 and to prevent the tie from becoming misplaced.

Soft cover 30 can be a fabric bag such as a nylon bag in this first embodiment. Cover 30 both covers and protects the bounce house and air blower 40 when the bounce house is not being used, and helps to secure bounce house 50 onto dolly 11 for transportation. Together, strap(s) 26 and/or cover 30 secure bounce house 50 on dolly 11 so that the frame 12 can be tilted for transportation without bounce house 50 falling off support surface 14. Cover 30 could even be an open fabric such as a net, while still effectively holding bounce house 50 onto dolly 11.

As described thus so far, deflated bounce house 50 is secured directly to dolly 11 via strap(s) 26 and then covered using cover 30. As an alternative, fabric cover 30 could define a fabric bag having straps or other attachments means attached to it, with the fabric bag being easily separatable from dolly 11. Deflated bounce house is placed into fabric bag 30 and held therein via the straps. Fabric bag 30 is then placed on dolly 11 and releasably secured to it using attachment means such as straps or buckles.

Figure 5:
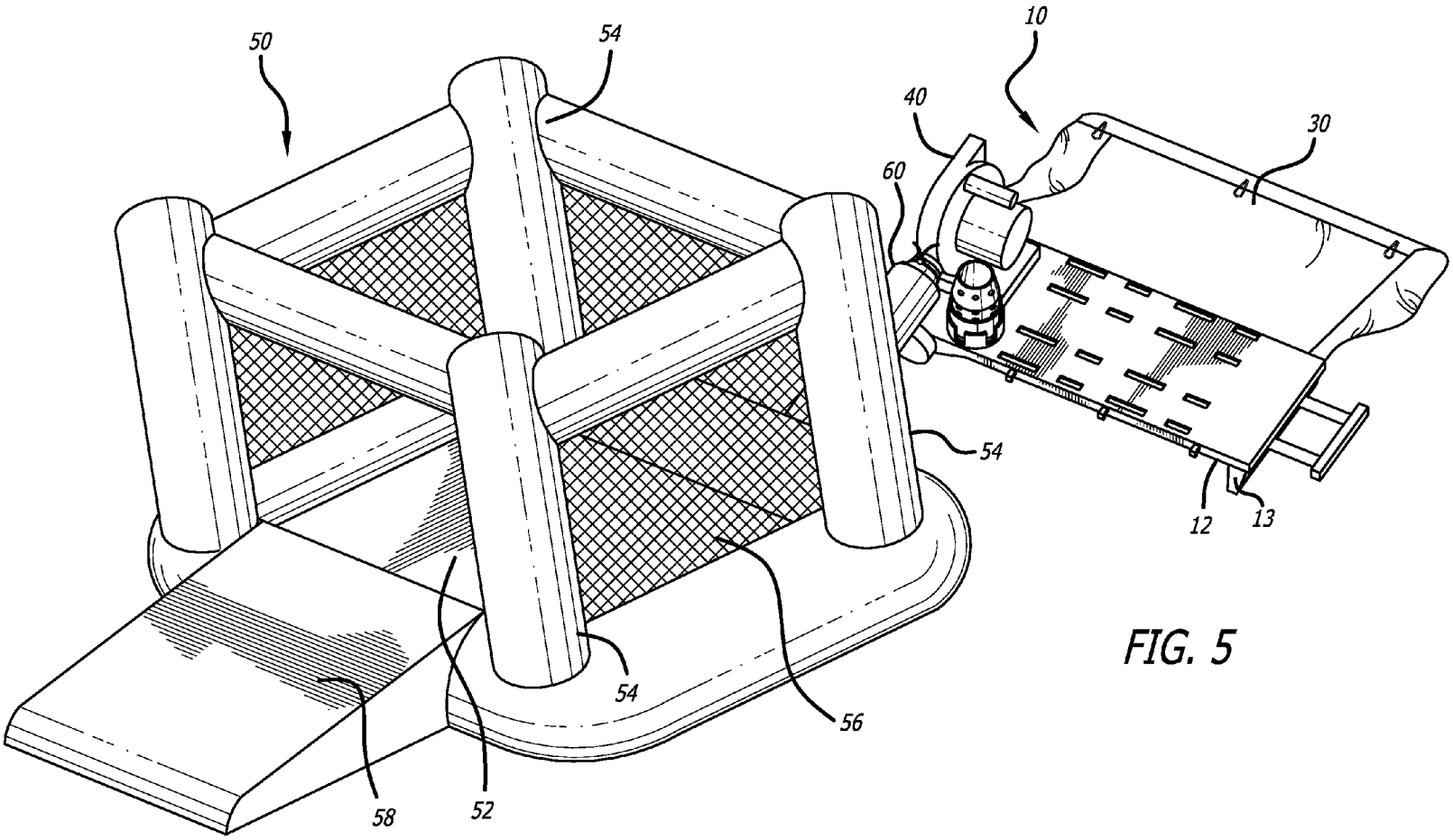
FIG. 5 is an oblique view of the assembly of FIG. 1, with the bounce house fully inflated.

FIG. 5 is an oblique view of the assembly 10 of FIG. 1, with the bounce house 50 fully inflated. In the exemplary embodiment, bounce house 50 includes an inflated floor 52, vertical supports 54, netting 56 that is connected between the vertical supports thereby forming soft walls of the bounce house, and a slide 58. Inflation tube 60 may be permanently attached as part of bounce house 50, or may be removably attachable to, for example, a side wall of floor 52. The bounce house can include a one-way valve such that once the bounce house has been inflated, it will not deflate until the valve is opened by the user thus allowing the air to escape.

Figure 6:
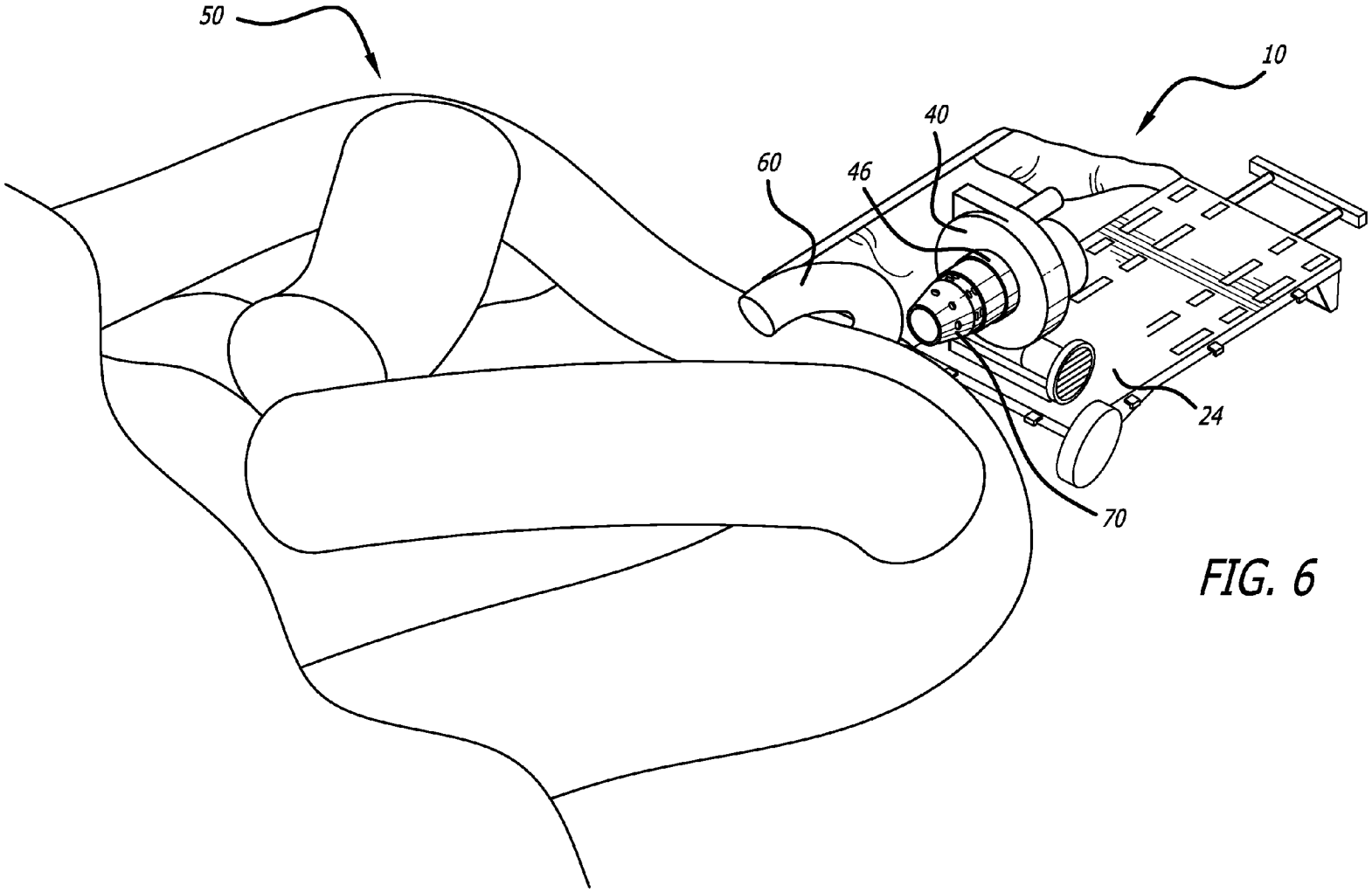
FIG. 6 is an oblique view of the assembly of FIG. 1, with the bounce house partially deflated.

FIG. 6 is an oblique view of the assembly 10 of FIG. 1 with the bounce house 50 partially deflated.

When the bounce house is done being used and the bounce house must be deflated for transportation and/or storage, many prior bounce houses simply relied on the weight of the bounce house itself to mostly deflate the structure, coupled with the user manually gathering, folding, and/or rolling up the bounce house in order to finish deflating it.

By contrast, the bounce house assembly 10 includes a power deflation port 46 on air blower 40 and mating power deflation nozzle or adapter 70 that makes deflating the bounce house much quicker and easier than with such prior bounce houses.

Figure 7:
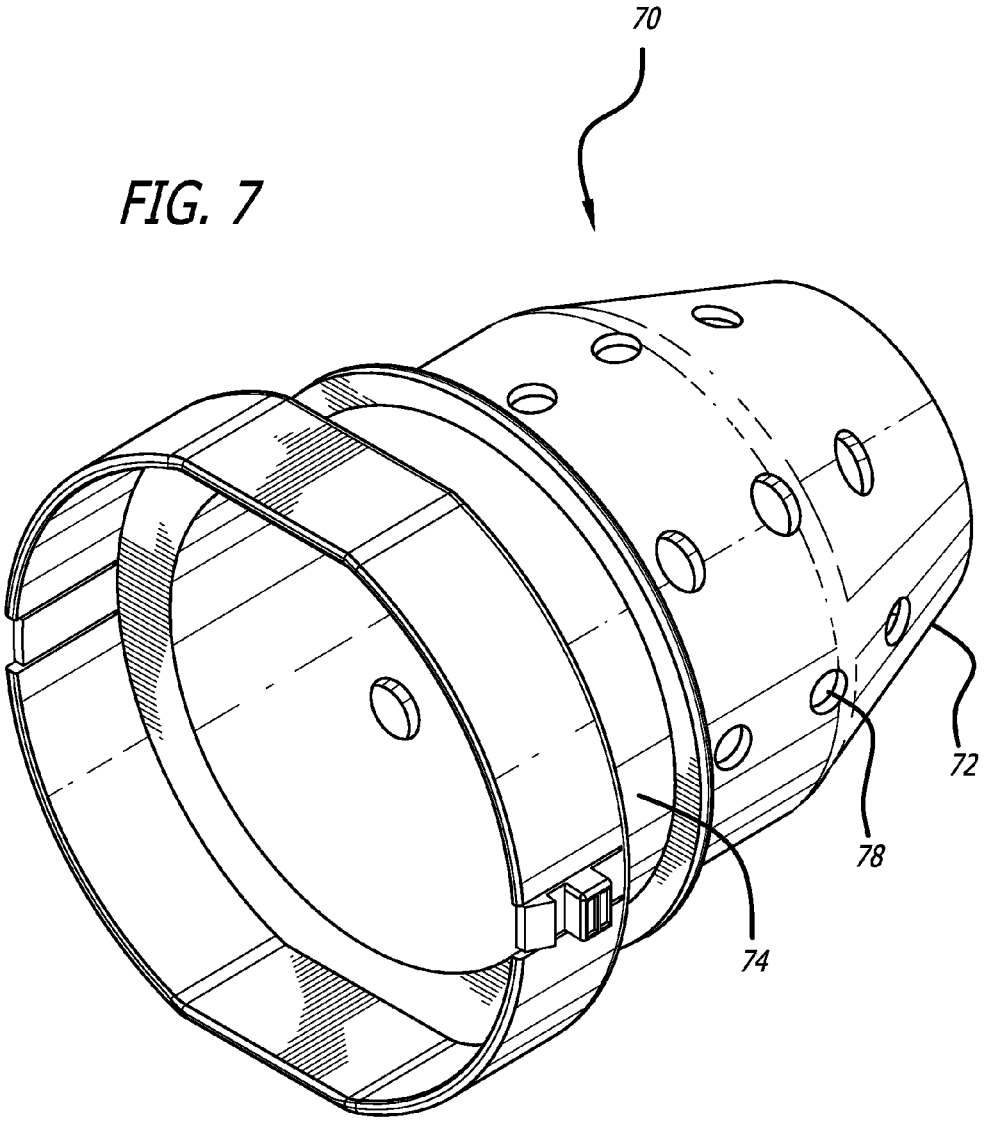
FIG. 7 is an oblique view of the power deflation adapter of the assembly of FIG. 1.

FIG. 7 is an oblique view of deflation adapter 70. Deflation adapter 70 includes a base 76 that mates with intake port or deflation port 46 on air blower 40, a frusto-conical portion 72 at its distal end, and a circumferential recess 74 that defines an intermediate portion having a reduced diameter. Base 76 can mate with deflation port 46 via an interference fit, via a loose interference fit including a snap locking mechanism as illustrated, via mating threads so that the deflation adapter screws onto the deflation port, or via other common and well known mating attachment means.

In order to deflate bounce house 50, the user first removes deflation adapter 70 from its mounting structure 24 on dolly 11, and places it over deflation port 46. The user then connects the open end of bounce house inflation tube 60, which now also defines a deflation tube such that the tube defines an inflation/deflation tube, over deflation adapter 70. The frusto-conical distal end 72 of the adapter renders it easy for a user to place the open end of deflation tube 60 over deflation adapter 70. The same tie elastic tie as seen in FIG. 4 can be used to secure the deflation tube to deflation adapter 70 by cinching the elastic tie around the deflation adapter at its circumferential recess 74. Such a tie, however, is not strictly needed, because once the air blower has been turned on, holes 78 in the deflation adapter 70 will provide suction to keep the walls of inflation tube 60 against the adapter, thus loosely holding tube 60 onto adapter 70.

Figure 8:
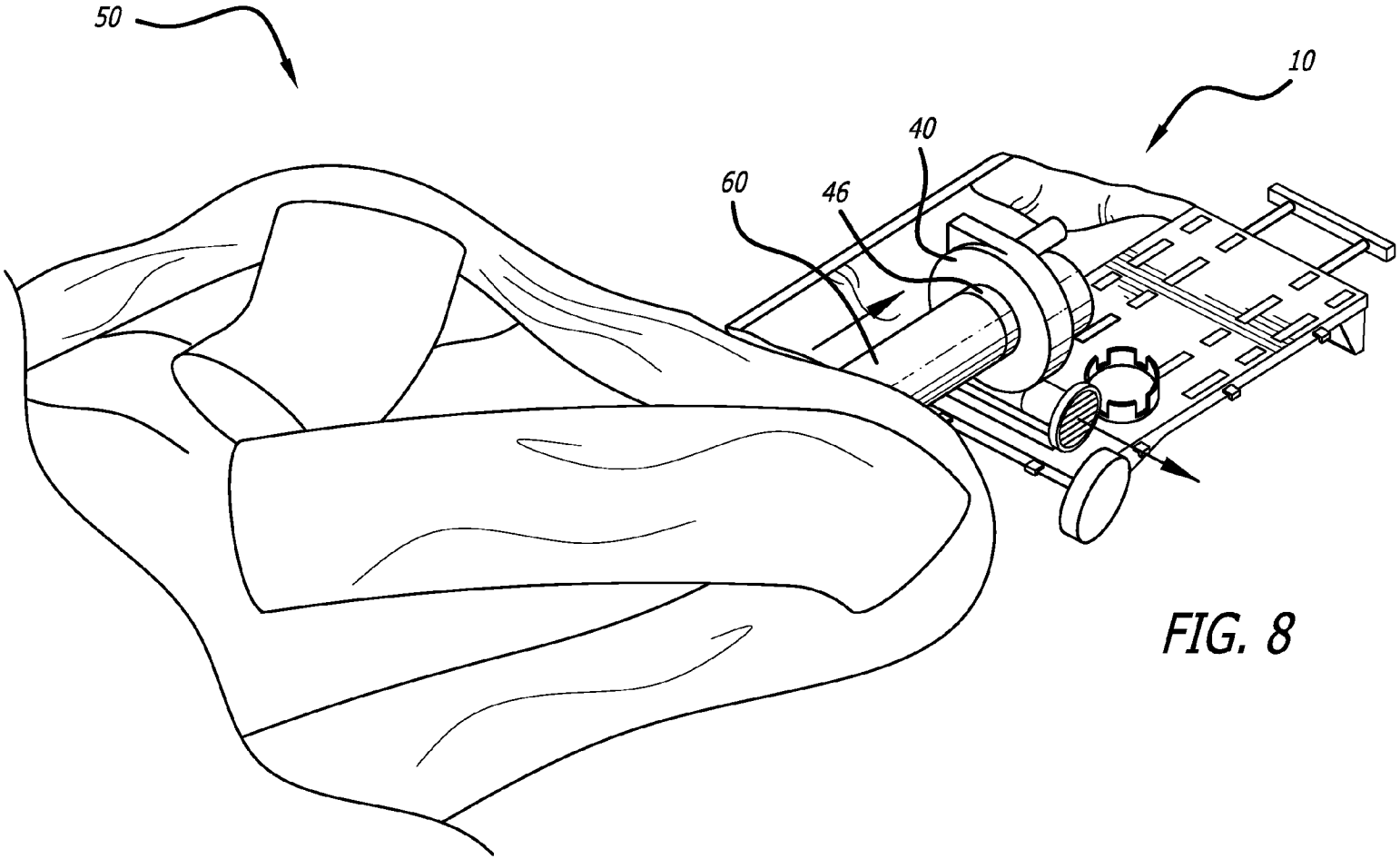
FIG. 8 is oblique view of the assembly of FIG. 6, with the inflation/deflation tube fitted onto the power deflation adapter and the air blower being used to power deflate the bounce house.

FIG. 8 is oblique view of the assembly of FIG. 6, with the inflation/deflation tube 60 fitted onto the deflation adapter 70, which in turn is fitted on intake port 46 of air blower 40. Blower 40 is sucking air through deflation tube 60 and thus from bounce house 50, and thus is power deflating the bounce house.

Figure 9:
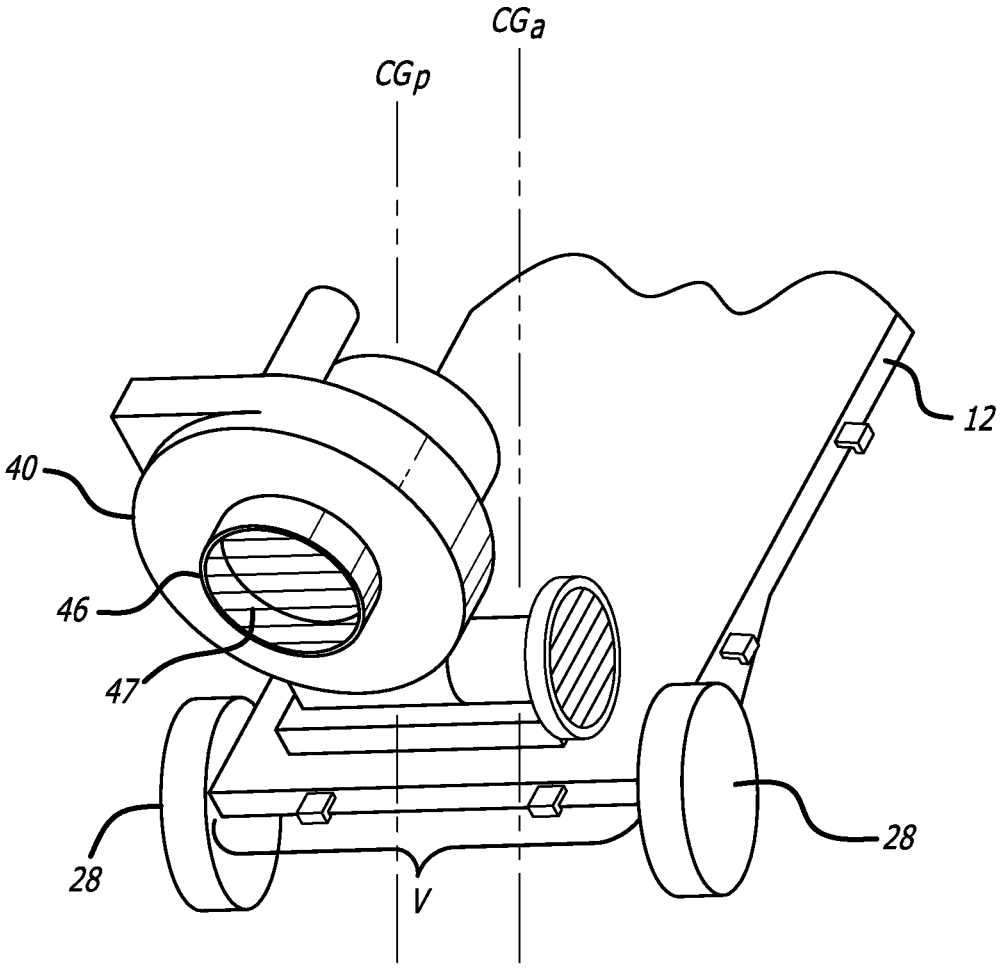
FIG. 9 is an oblique close-up view of the assembly of FIG. 1 in the area of the wheels when being transported.

FIG. 9 is an oblique close-up view of the assembly 10 of FIG. 1 in the area of the wheels when being transported. In order to make the assembly 10 as seemingly light as possible for a user when the user is rolling assembly 10, the air blower 40, which is expected to be the heaviest and densest part of the assembly, is located at a first end of dolly 11 near the wheels 28 and opposite user handle 16. In a particular embodiment, the weight is distributed such that when a user having a height of 4'6" to 6' is grasping the handle and walking, the frame 12 is tilted at least 20° relatively to horizontal, and at least one of the following conditions is met: (a) the center of gravity $CG_P$ of air pump or blower 40 is located over a volume V that is defined by a space between the two wheels 28; (b) the center of gravity $CG_A$ of assembly 10 is located over volume V; (c) the majority of the weight of the air blower is borne by the wheels; and/or (d) the majority of the weight of the entire assembly 12 is borne by the wheels.

The blower could also be positioned on the frame 12 such that when a user is not holding the handle and the frame 12 rests against the ground, center of gravity $CG_P$ of blower 40 is located over volume V. In this way, if a user wants to relocate the dolly 11 by pushing it slightly without tilting it up and grasping it by the handle, the dolly will still seem relatively light.

Figure 10:
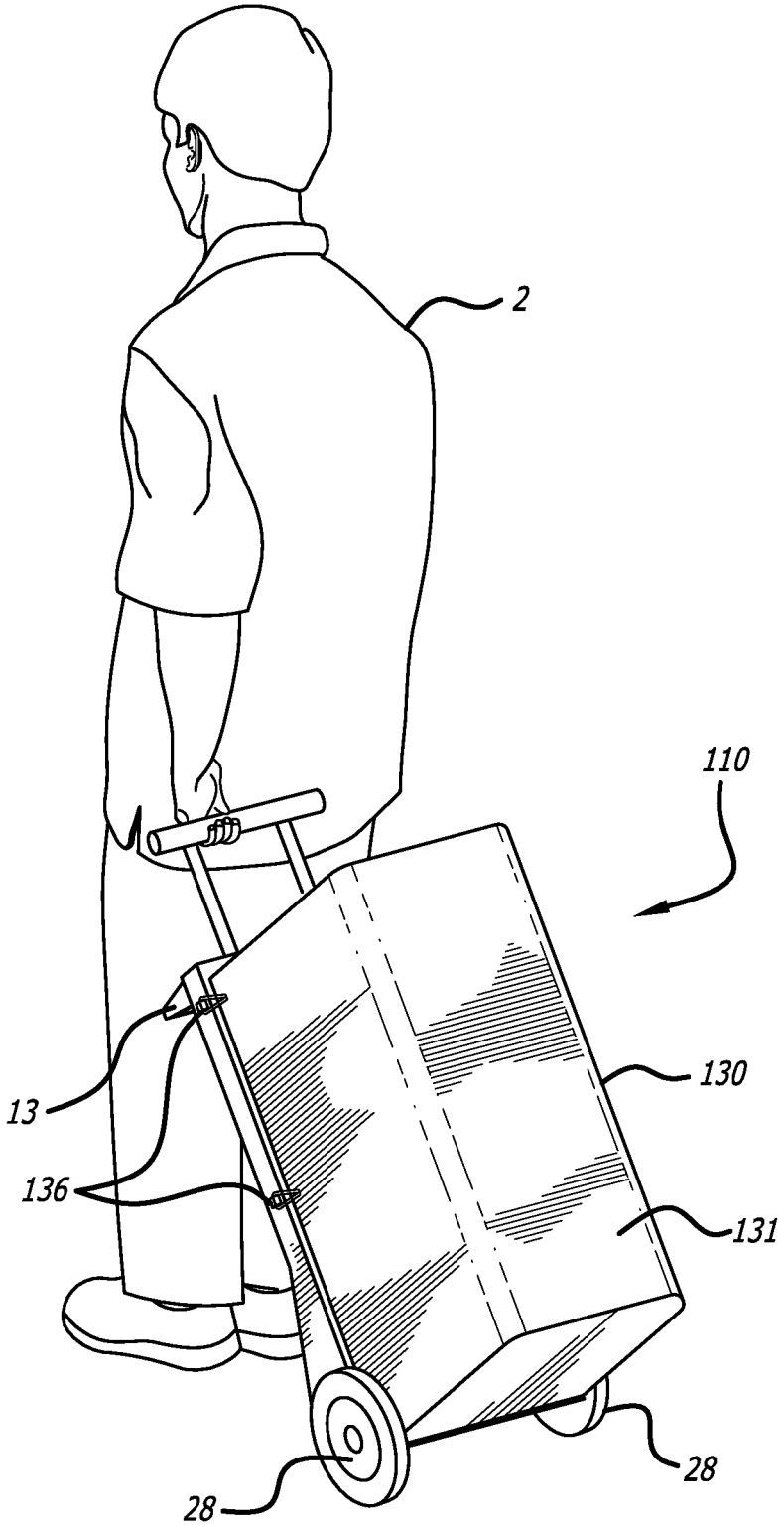
FIG. 10 is an oblique view of a user wheeling the assembly according to a second exemplary embodiment which includes a hard cover.

FIG. 10 is an oblique view of a user wheeling an assembly 110 according to a second exemplary embodiment which includes a hard cover 130. Hard cover 130 could be made of a hard plastic such as HDPE, and could be either hinged to the dolly at one end or could be fully releasable from the dolly, and attached via attachment means such as buckles 136. The top of cover 130 could be flat such that when the assembly 110 is not in use, other objects can be placed and stored on its flat top 131. In that way, floor space in the user's garage would not need to be dedicated to only the bounce house assembly. Such a design would be advantageous, for example, in a user's garage where storage space is at a premium, as is often the case in the garage of parents who have growing children.

In another variation that is not illustrated, instead of the dolly 11 being a 2-wheeled dolly that is tilted for transportation, the dolly could be a 4-wheeled dolly having one wheel generally at each corner with a handle provided, such that the dolly is similar in form to a wagon.

The assembly 10 or 110 thus define a bounce house and related equipment including an inflation/deflation pump, that can be easily transported to a use location such as a public park or to another parent's house, or merely from the garage to the back yard. The bounce house can easily be inflated, and easily and quickly deflated and folded or rolled up, and transported back. The assembly thus makes it easy to take a bounce house to a location and use it there, such as for example taking a bounce house to a public park for child's birthday party or other event being held there.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

We claim:

1. An assembly for a bounce house and for transporting and inflating said bounce house, the assembly comprising:
- a wheeled dolly, the wheeled dolly having wheels for rolling across a ground surface;
- a handle secured to the wheeled dolly for use by a user when moving the dolly;
- an inflatable structure, said inflatable structure having when it is inflated:
  - an inflated floor that is suitable for children to jump thereon; and
  - inflated supports for containing the children within the structure;
- an electrically powered air blower secured on the dolly, the inflatable structure and the air blower being adapted so that the air blower can be used to inflate the inflatable structure; and
- means for securing the inflatable structure to the wheeled dolly when the inflatable structure is in a deflated state, the inflatable structure in its deflated state defining a deflated structure;
- whereby the dolly can be wheeled by a user by the handle to thereby transport the deflated structure and the air blower, with both the deflated structure and the air blower being secured on the dolly.

2. The assembly of claim 1 wherein the air blower is secured on the dolly in a position such that when the user is wheeling the dolly, a majority of a weight of the air blower is borne by the wheels.

3. The assembly of claim 1 further comprising:
- an adapter nozzle for connecting an inflation hose of the inflatable structure to the air blower such that the blower can be used to deflate the inflatable structure; and
- a mounting structure for securing the adapter nozzle to the wheeled dolly.

4. The assembly of claim 1 wherein said means for securing the inflatable structure to the wheeled dolly comprises a cover that is hinged along one longitudinally extending edge of the dolly.

5. The assembly of claim 1 wherein said means for securing the inflatable structure to the wheeled dolly comprises:
- a fabric bag;
- a plurality of straps attached to the bag for securing around the deflated structure to hold the deflated structure in the bag; and
- means for releasably securing the bag to the dolly.

6. The assembly of claim 1 wherein said means for securing the inflatable structure to the wheeled dolly comprises:
- a fabric cover, the cover having a first portion thereof that is secured to the dolly;
- straps for holding the deflated structure to the cover; and
- means for releasably securing a second portion of the cover to the dolly.

7. An assembly for a bounce house and for transporting and inflating said bounce house, the assembly comprising:

an inflatable structure, said inflatable structure having when it is inflated:

an inflated floor that is suitable for children to jump thereon; and inflated supports for containing the children within the structure;

a frame having a support surface for supporting the inflatable structure when the inflatable structure is in a deflated state;

at least one wheel mounted to the frame for allowing the frame to roll over a ground surface on the wheel;

an electrically powered air blower mounted to the frame;

a handle attached to the frame for a person to grasp when rolling the frame over the ground surface; and a cover for covering the inflatable structure when the inflatable structure is in its deflated state, and for securing the inflatable structure on the support surface such that the frame can be tilted for transportation without the inflatable structure falling off the support surface.

8. The assembly of claim 7 wherein:

said at least one wheel comprises two wheels spaced apart on laterally opposite sides of the frame; and the air blower is positioned such that when a user is holding the handle and wheeling the frame across the ground surface, a center of gravity of the air blower is disposed over a volume defined by a space between the two wheels.

9. The assembly of claim 7 wherein:

said at least one wheel comprises two wheels spaced apart on laterally opposite sides of the frame; and the air blower is positioned on the frame such that:

when a user is holding the handle and wheeling the frame across the ground surface, a center of gravity of the air blower is disposed over a volume defined by a space between the two wheels; and when a user is not holding the frame and the frame is at rest on the ground surface, the center of gravity of the air blower is disposed over said volume.

10. The assembly of claim 8 wherein:

the frame has exactly two wheels for rolling the assembly across the ground surface; and when a user is holding the handle and wheeling the frame across the ground surface, the frame is tilted at an angle of at least 20° relative to horizontal.

11. The assembly of claim 7 wherein said at least one wheel comprises four wheels disposed generally at four opposing corners of said frame, respectively.

12. The assembly of claim 7 wherein the frame has a plurality of attachment points for attaching the cover thereto.

13. The assembly of claim 7 wherein:

the cover comprises a fabric cover; and the assembly further comprises means for releasably attaching the fabric cover to the frame.

14. The assembly of claim 7 wherein the cover comprises a generally rigid cover, the assembly further comprising means for releasably attaching the generally rigid cover to the frame.

15. The assembly of claim 7 further comprising an adapter nozzle for connecting an inflation hose for the inflatable structure to a suction port of the air blower such that the blower can be used to deflate the inflatable structure.

16. The assembly of claim 7 wherein said inflatable structure comprises a child's bounce house.

17. An assembly comprising:

a wheeled dolly, the wheeled dolly having wheels for rolling across a ground surface;

an electrically powered air blower secured on the dolly, the air blower having an intake port and an exhaust port;

a child's bounce house having:

an inflated state in which a child can enter the bounce house and jump therein, the bounce house having in its inflated state an inflated floor that is suitable for children to jump thereon and inflated supports for containing children within the bounce house; and a deflated state in which the bounce house can be placed on the dolly;

means for connecting the inflatable structure to an exhaust port of the air blower such that the air blower can be used to inflate the inflatable structure; and means for connecting the inflatable structure to an intake port of the air blower such that the air blower can be used to deflate the inflatable structure.

18. The assembly of claim 17 wherein said means for connecting the inflatable structure to the intake port of the air blower comprises:

a flexible tube in fluid communication with the bounce house; and an adapter for connecting the flexible tube to the intake port of the air blower.

19. The assembly of claim 18 wherein said adapter has:

a frusto-conical section for being received within an open end of the flexible tube; and a circumferential recess.

20. The assembly of claim 18 wherein said adapter has a plurality of holes therein, the holes allowing suction from the air blower's intake port to reach side walls of the flexible tube thereby tending to hold the flexible tube onto the adapter.

* * * * *